United States Patent [19]

Brake et al.

[11] Patent Number: 4,967,683

[45] Date of Patent: Nov. 6, 1990

[54] MARINE UNITS

[75] Inventors: Arthur L. Brake, Winscombe; Andrew L. Pole, Langford; Charles D. Papworth, Briston, all of England

[73] Assignee: BAJ Limited, Banwell, England

[21] Appl. No.: 389,359

[22] Filed: Aug. 3, 1989

[51] Int. Cl.[5] ..... H04B 1/34

[52] U.S. Cl. ..... 114/312; 248/168

[58] Field of Search ..... 405/195, 203, 205, 207, 405/208, 224; 367/3–6; 181/101, 108, 110, 113, 117–120; 114/293, 312, 264, 265; 441/1, 6, 7, 21, 32, 33; 73/170 R, 170 A; 244/138 R; 343/709, 710, 713, 719, 872, 873, 878, 880–882; 248/166, 150, 168–171, 434, 435, 370, 4.36, 163.1; 102/401, 406, 411, 415, 351, 357, 387, 390

[56] References Cited

U.S. PATENT DOCUMENTS

| | | | |
|---|---|---|---|
| 1,859,289 | 5/1932 | Dalton | 248/171 |
| 2,398,794 | 4/1946 | Maltby | 102/411 |
| 3,870,263 | 3/1975 | Hardiman | 248/168 |
| 4,022,414 | 5/1977 | Egger | 248/150 |
| 4,738,421 | 4/1988 | Green | 248/168 |

*Primary Examiner*—Joseph F. Peters, Jr.
*Assistant Examiner*—Clifford T. Bartz
*Attorney, Agent, or Firm*—Wallenstein, Wagner & Hattis, Ltd.

[57] ABSTRACT

A marine unit has an elongate payload-containing body, a plurality of legs each connected by a pivot at its inner end to the lower end of the body, and an actuator in the body for deploying the legs to cause the body to stand upright on the sea bed. The actuator is a double-acting constant displacement piston and cylinder arrangement connected to each of the legs by a link. The link is connected to the piston by a second pivot and to the leg by a third pivot, the geometry of the three pivots being such that the linkage is self-locking and reverse loads on the leg are not transferred to the actuator.

12 Claims, 9 Drawing Sheets

MARINE UNITS

Technical Field

This invention relates to marine units and is particularly concerned with the construction of such units which are arranged to be deployed on and supported from the sea bed.

Background Prior Art

The present invention is particularly concerned with units having an elongate payload-containing body which is to be maintained on the sea bed in an approximately vertical position. The units may serve various purposes, but in general the invention is concerned with relatively small units, for example, units of less than ten or more, preferably less than five meters in height; for example, such units may incorporate electronic equipment, such as navigation equipment.

British patent specification No. GB-B-2163200, issued to BAJ LIMITED, the Assignee of the present application, discloses a marine unit which has an elongate payload-containing body and a plurality of legs adapted to rest on the sea bed and to maintain the body in an approximately vertical position, each leg being connected at one end to the body by a pivot adjacent the lower end of the body and each leg being pivotable from a closed position adjacent to the body to a deployed position extending away from the body, and an actuator in the body connected to the legs to pivot the legs simultaneously from the closed position to the deployed position.

Summary of the Invention

An object of the invention is to provide a marine unit which is reliable in use, robust and efficient.

According to the present invention, the actuator has a common axially-moving member which is connected to each leg by means of a link which is pivoted to the leg at a point which is radially within the pivotal axis of the leg and arranged so that, on full deployment of the leg, forces on the leg tending to return the leg to the closed position do not act on the said common member in a direction to tend to return the piston in a direction opposite to the deploying direction. Thus, the linkage is self-locking.

According to the present invention, the legs of the marine unit are operated by a single actuator, which is preferably a piston and cylinder, and more preferably an annular piston and cylinder coaxial with the marine unit. The piston and cylinder is preferably of double-acting construction, and more particularly of constant displacement construction. With a double-acting constant displacement piston and cylinder arrangement, no provision has to be made for "piston rod volume" and operation can be by means of a pump transferring hydraulic fluid from one side to the other side of the piston without connection to a reservoir, although a recuperation chamber may be provided. Preferably, the pump is an electrical pump.

At the end of the unit remote from the pivotal axes of the legs, there is preferably a cover retained by the distal ends of the legs and released by the deployment of the legs. Preferably, the legs are held against deployment by a ring removable on deployment. Preferably, there are spring means tending to move the legs in the deployed direction when the ring is removed. In addition, such springs may provide cushioning to shield the body from impacts on the legs when they are in an initially-deployed condition. Additionally or alternatively, there may be dashpot means between the legs and the body for cushioning purposes and the spring and dashpot may be combined in a single plunger and cylinder structure incorporating a coil spring.

Preferably, the unit incorporates a water parachute or drogue which may initially be connected to all the legs but be releasable from all but one of the legs on deployment of the legs. With this arrangement, it is possible to provide that the leg to which the drogue is permanently attached pulls the drogue clear of the body on full deployment.

Figure 12:
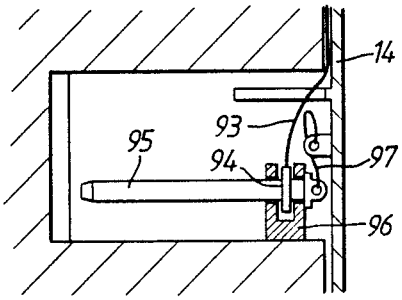
Figure 13:
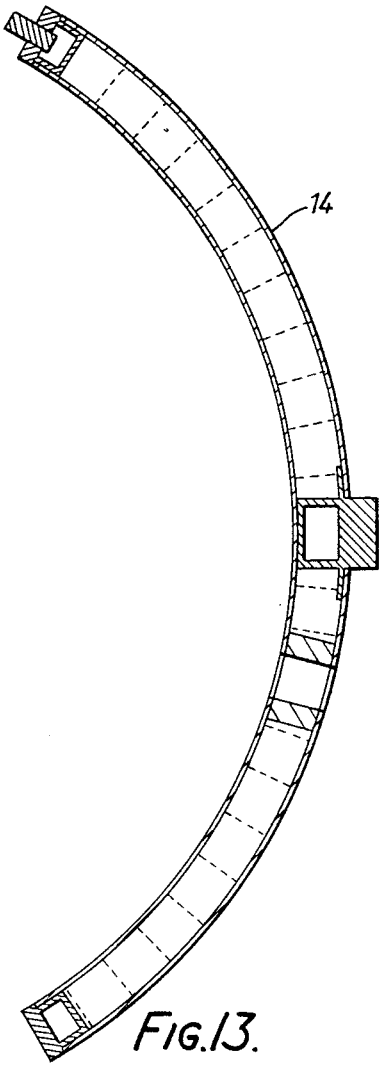

FIG. Il is a fragmentary view showing a spring and dashpot unit for one of the legs;

FIG. 12 shows a releasable connection between the lanyard holding the drogue and one of the legs; and, FIG. 13 is a cross-section through one of the legs.

Detailed Description

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to embodiment illustrated.

Figure 1:
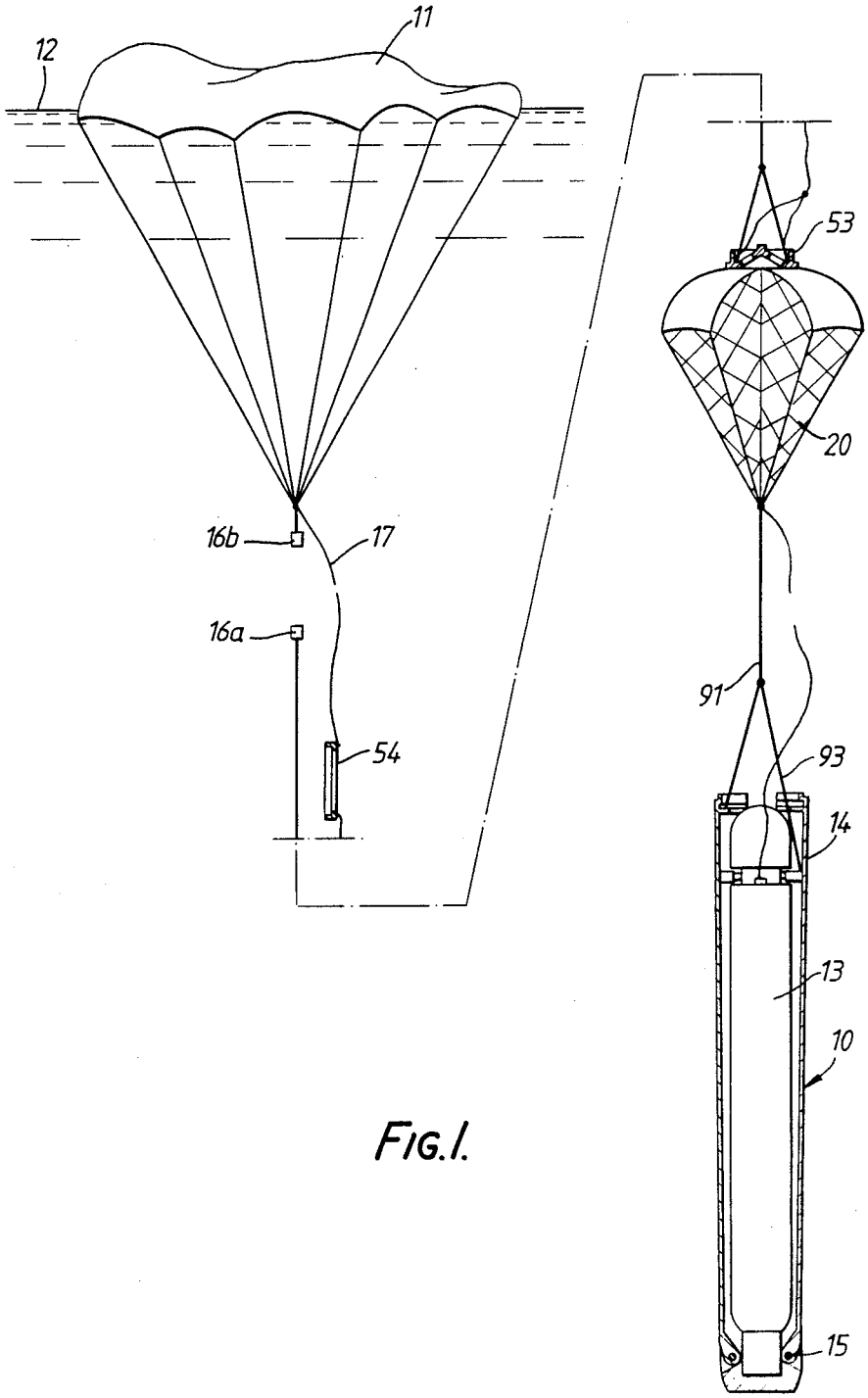
FIGS. 1–4 show various stages in the deployment of a marine unit which is in accordance with the invention and which is air-launched, FIG. 1 showing the condition shortly after the unit enters the water, FIG. 2 showing the unit lying on the sea bed, FIG. 3 showing an intermediate stage in the deployment of the legs, and FIG. 4 showing the unit with the legs fully deployed and the body of the unit upright.

Turning now to the drawings, FIG. 1 shows a marine unit 10 which has been launched from an aircraft and having descended under the control of an air parachute 11 is now sinking in the water below the surface 12 under the control of a water parachute or drogue 20. The unit comprises a body 13 to which are pivoted three legs 14, each leg being pivoted at its lower end by a pivot pin 15 to the lower end of the body 13 and extending the full length of the body and having an arcuate cross-section, as can be seen in FIG. 13, the arc extending through approximately 120° so that the three legs between them substantially enclose the body 13.

The air parachute 11 is connected to the remainder of the unit by a load separable link **16*a*, 16*b* and an easily breakable pull cord 17**.

Figure 2:
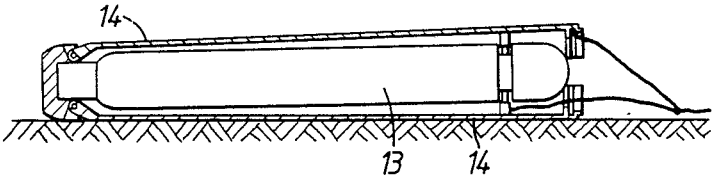

When the unit reaches the sea bed, it may become partially buried or may lie horizontally on the sea bed as seen in FIG. 2. The body 13 contains an actuator to be described below which, on operation, causes the legs to pivot away from the body so that the body moves towards an upright position through the intermediate position shown in FIG. 3 to the fully upright position shown in FIG. 4 in which the three legs rests on the ground with the body substantially vertical.

Figure 8:
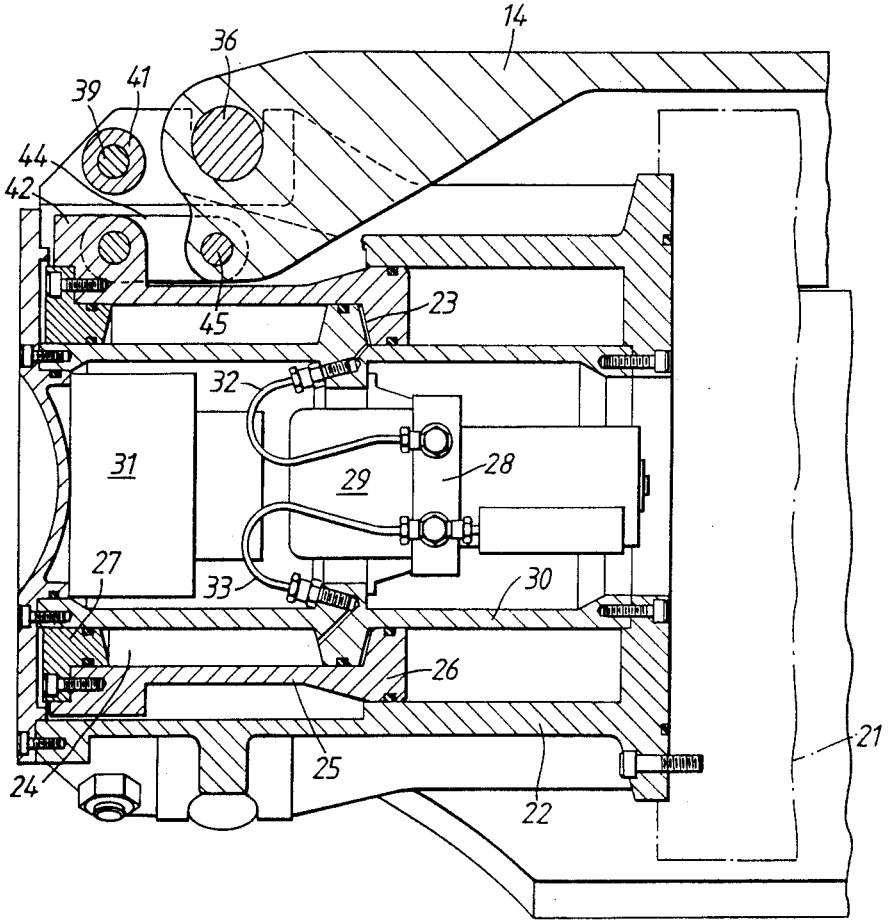
FIG. 8 is a longitudinal section of the portion of the unit shown in FIG. 5.

Referring now to FIGS. 5–8 which show the lower end of the unit in detail, it will be seen that attached to the lower end of a main body section 21, which is only indicated in outline in FIG. 8, is an outer cylinder member 22 and an inner cylinder member 30 between which an annular piston member 25 slides, thus forming a first cylinder chamber 23 and a second cylinder chamber 24. The annular piston member 25 has an enlarged upper end 26 and a lower closure member 27 so that the piston member 25 and the closure member 27 enclose the cylinder chamber 24. Within the inner cylinder member 30 there is a pump unit 28 operated by an electric motor driven from batteries 31 and located behind the pump unit 28, as viewed in FIG. 8. The two-directional pump 28 has one port connected by a line 32 to the cylinder chamber 23 and the other port connected by a line 33 to the cylinder chamber 24. Also connected to the line 33 is a hydraulic recuperator or accumulator 29 which is pressurized to maximum sea pressure, say 500 psi (3450 kPa).

The outer cylinder member 22 is formed with three pairs of outwardly-extending parallel flanges 34*a*, 34*b*, each of each is formed with a transverse outwardly-facing groove 35*a*, 35*b* which receive a pivot pin 36 on which one of the legs 14 is pivoted and which is retained in position by cap screws 37 passing through holes in the pivot pin 36 and entering tapped holes 38 in the bases of the grooves 35*a*, 35*b*. The flanges 34*a*, 34*b* of each pair are restrained from moving away from one another under load by a bolt 39 surrounded by a spacer sleeve 41.

The piston member 25 is formed at its lower end with three sets of lugs 42, each set consisting of three lugs 421*a*, 43*b*, 42*c* through which passes a pin 43 on which are pivoted two short links 44 which, when the legs are in their non-deployed condition, extend generally axially upwardly of the unit, as can be seen in FIG. 8. The upper ends of each pair of links 44 are pivoted by a pin 45 to the lower end of one of the legs 14 at a point which, when the legs are in their undeployed position, is approximately radially within the pivot 36 of the leg concerned.

Figure 9:
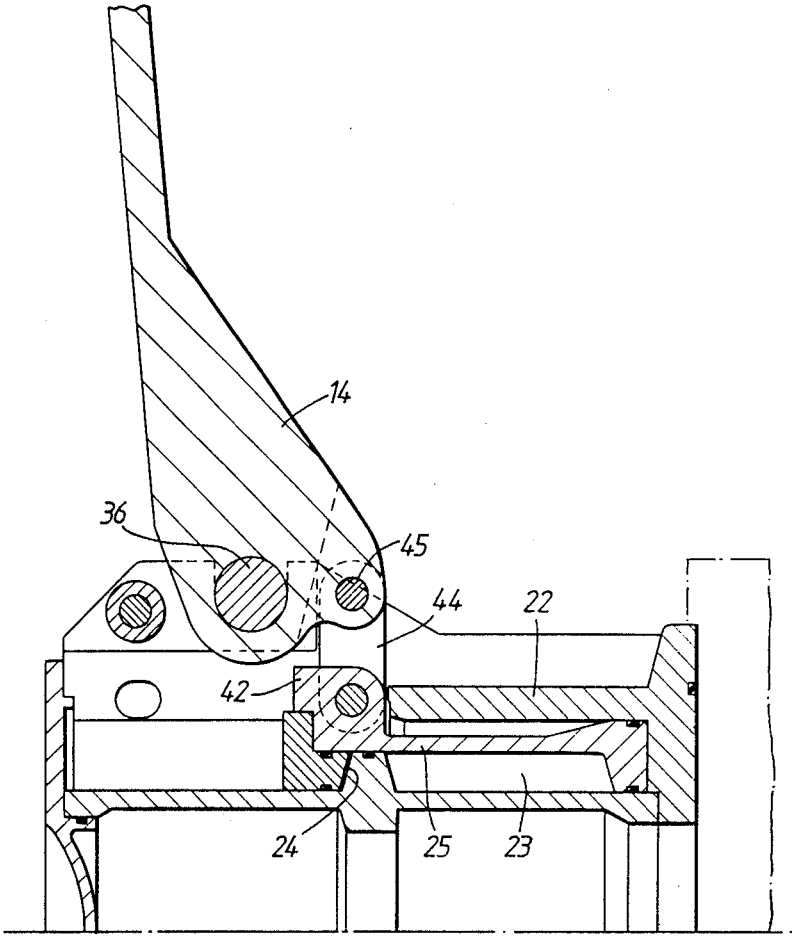
FIG. 9 is a view, similar to part of FIG. 8, showing the legs in a fully-deployed position.

When the legs are to be deployed, the motor is actuated in a direction to deliver hydraulic fluid through the pipe 32 into the cylinder chamber 23 and to withdraw hydraulic fluid from the cylinder chamber 24 through the pipe 33. Thus, the piston member 25 is moved to the right from the position shown in FIG. 8 to the position shown in FIG. 9. Load is transferred from the piston member 25 to the legs 14 through the links 44 which swing from the position shown in FIG. 8, in which they extend generally axially of the unit, to the position shown in FIG. 9, in which they are approximately radial to the axis of the unit. Although not shown in the drawings, the hydraulic system includes valves which, when the pump 28 is not in operation, prevent flow between the cylinder chambers 23 and 24 so that movement of the legs 14 is resisted hydraulically and it may therefore be arranged for the legs to be retained in an intermediate position. However, when the legs are in the fully deployed position, as seen in FIG. 9, loads on the legs tending to move then towards the undeployed position are directed generally along the length of the links 44 and, if anything, tend to move the piston member 25 further to the right, as seen in FIG. 9, although such movement is not possible as the piston is at its extreme position. A mechanical lock is thus provided.

Figure 10:
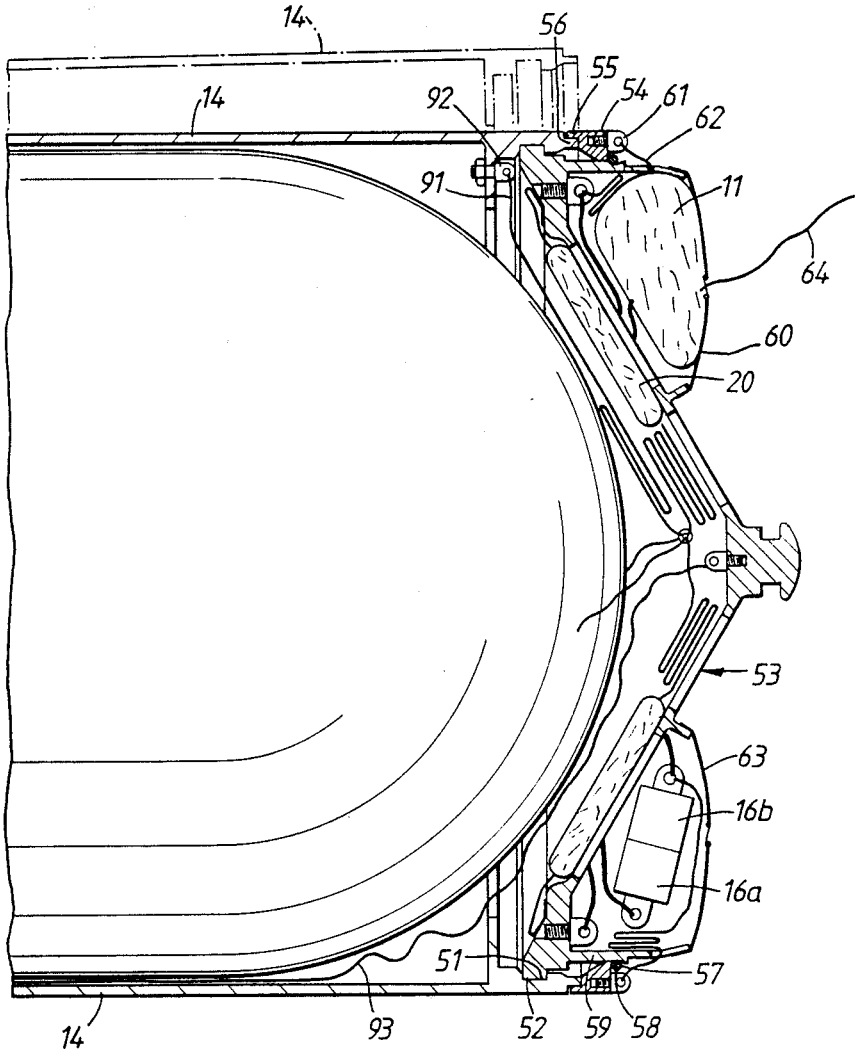
FIG. 10 is a longitudinal section of the top end of the unit.

Turning now to FIG. 10, the right-hand or left-hand end of the unit is shown. The upper or distal end of each of the legs 14 is formed with an inwardly-directed groove 51 which receives an outwardly-directed flange 52 on the outer edge of a generally conical-shaped cover member 53. The legs 14 are retained in a fully-closed or non-deployed position by a snatch ring 54 having an inwardly-facing rebate 55 engaging an outwardly-facing rebate 56 on the upper ends of the legs 14. The snatch ring 54 is normally retained in position by a circlip 57 located in a groove 58 in the outer surface of a cylindrical flange 59 extending upwardly from the cover 53. The upper flange of the groove 58 is inclined so that the circlip 57 can be expanded and moved upwardly to clear the cover member. The snatch ring carried lugs 61 to which are attached lanyards 62 by which the snatch ring may be moved axially upwards, as will be described below. The air parachute 11 is stored in a frangible annular container 60 on the upper side of the cover 53. The frangible container 60 also contains a load-separable link 16*a*, 16*b*. The sea parachute or drogue 20 is stored beneath the cover 53.

Operation will now be described with reference to FIGS. 1 and 10. When the unit is air launched, the air parachute 11 will be pulled out by a static line 64 and the unit suspended from the parachute by means of the load-separable link 16*a*, 16*b*, the integrity of the link being maintained by the tension in the line. When the unit falls into the sea, it will sink and the load on the link 16*a*, 16*b* will fall. The link is constructed so that because of the reduction, it will separate and the unit will continue to sink while the drag provided by the air parachute 11 will strain the static line 17 which is connected to the lanyards 62 so that the snatch ring 54 is pulled axially clear with release of the circlip 57. Once the rebates 55 and 56 separate from one another, the legs 14 are free to open, and when this occurs, the flange 52 will be cleared from the groove 51 and the cover 53 will come clear from the unit. This will cause the drogue 20 to be released and the unit will descend under the control of the drogue in the manner shown in FIG. 1.

Figure 11:
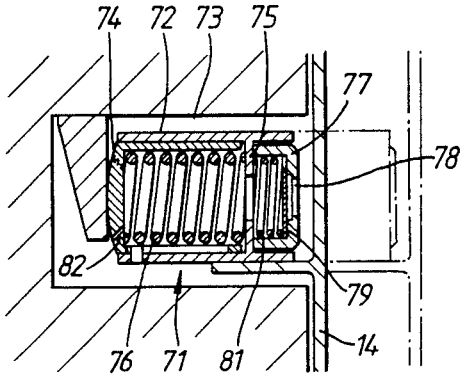

FIG. 11 shows a combined actuator spring and dashpot arrangement, one of which is located between the body and each of the legs 14 with its axis extending radially of the body. The unit comprises an inner cylinder member 72 and cup member 74 which can slide in a cylinder 73 which is attached to the leg 14. The outer cylindrical member 73 is formed with an inwardly-directed flange 75 and a compression spring 76 operates between this flange and the closed end of the cup member 74. Outwardly of the inwardly-directed flange 75, the outer cylindrical member 73 is provided with another cup member 77 in the base of which there is an aperture 78 normally closed by a flap valve 79 controlled by a spring 81. The closed end of the cup member 74 contains a throttle passage 82.

When the leg 14 is in its closed or non-deployed condition, as shown in full lines in FIG. 11, the springs 81 and 76 are compressed and thus bias the leg outwardly. When the snatch ring is pulled clear and the leg 14 is released from the restraint by the snatch ring, the spring 76 moves the legs outwardly to the position shown in chain dotted lines in FIG. 11 and while this occurs the flap valve 79 opens to admit water to the interior of the device. The dimensions are such that the legs rotate through approximately half a degree under the influence of the spring 76. If the unit should topple onto its side, any impact will be cushioned by the spring 76 and by the dashpot effect produced by closure of the flap valve 79 (which acts as a check valve), water within the device being expelled through the throttle passage 82.

Figure 3:
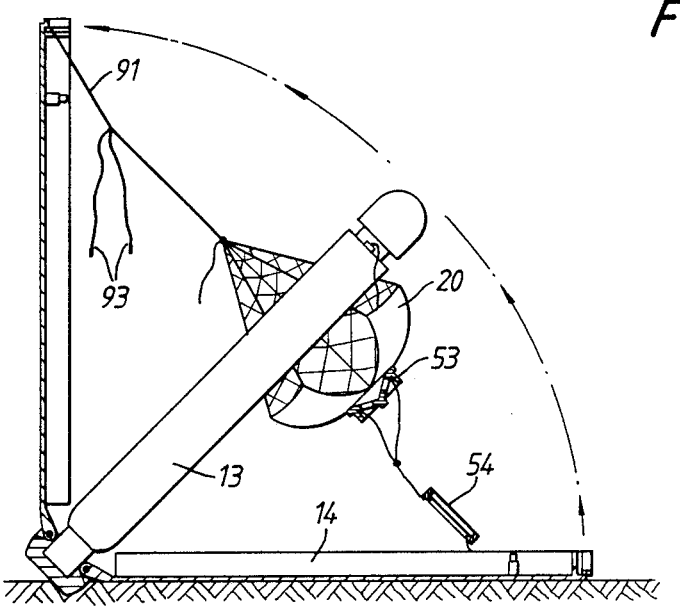
Figure 4:
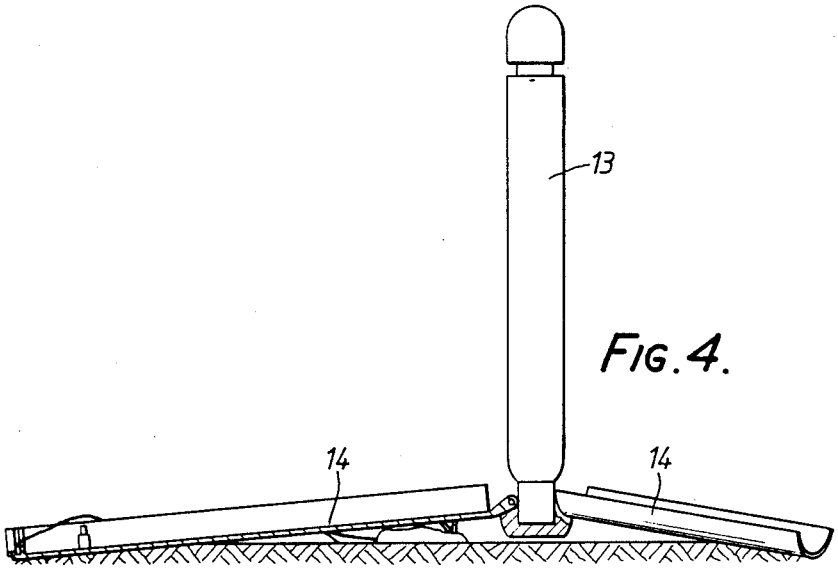
Figure 5:
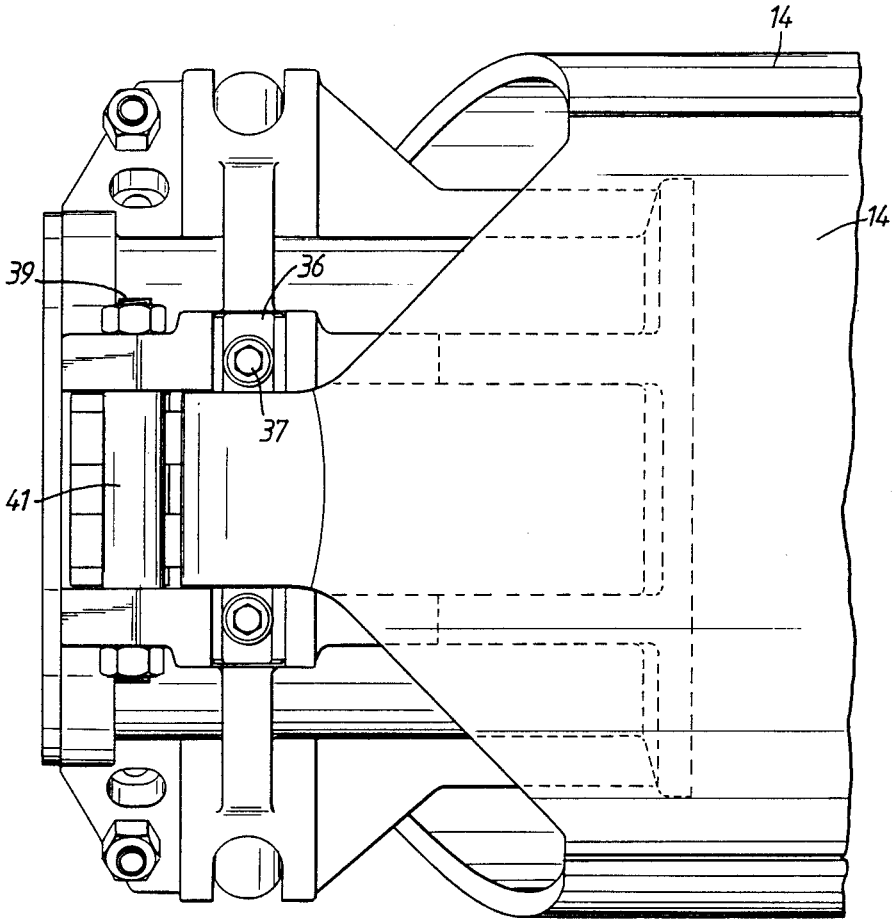
FIG. 5 is a side elevation to a larger scale of the lower end of the unit in the region in which the legs are pivoted to the body.
Figure 6:
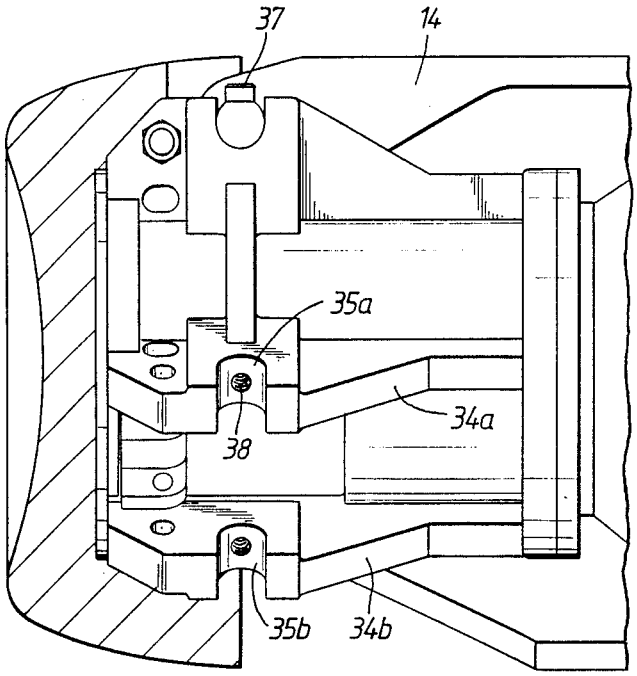
FIG. 6 is a view similar to FIG. 5 but to a smaller scale with one of the legs removed.
Figure 7:
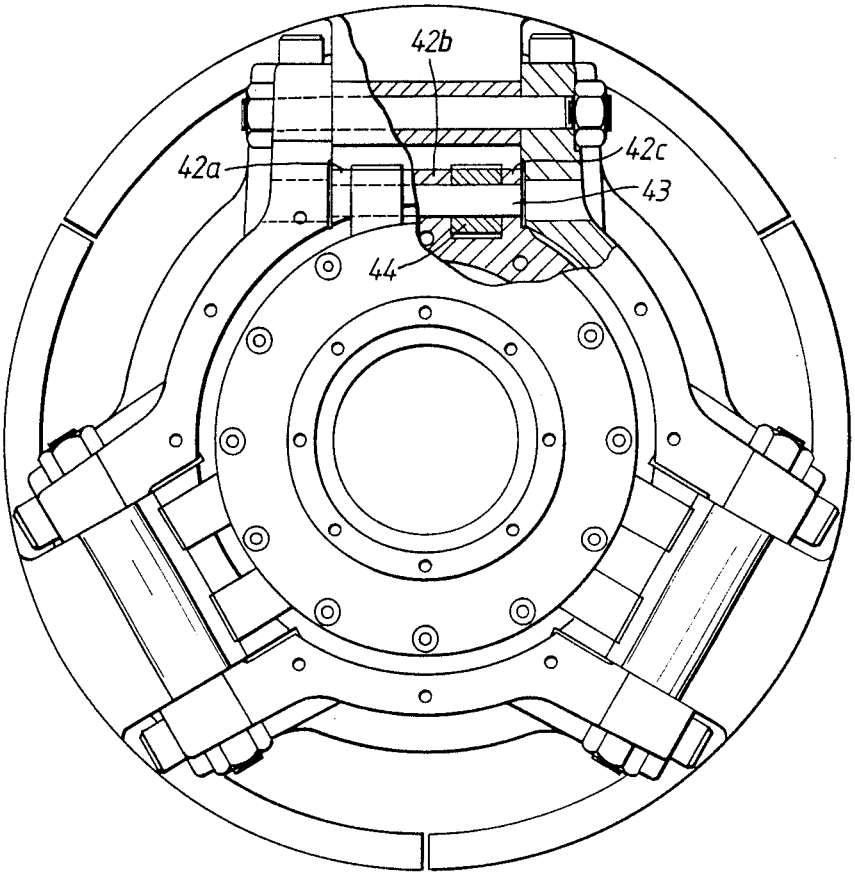
FIG. 7 is an end elevation partly in section, as viewed from the left in FIG. 5.

As mentioned in relation to FIG. 3, the drogue 20 is permanently connected by a first strap 91 to a lug 92 on one of the legs and is releasably connected by two further straps 93 to the other two legs. FIG. 12 shows the release mechanism. Each strap 93 terminates in a ring 94 which engages around a pin 95 passing through a clevis 96 in the body of the unit. One end of the pin 95 is connected to the respective leg 14 by a strap 97. This strap is of sufficient length for the leg to be able to move from the fully closed position to the partially open position shown in chain dotted lines in FIG. 11 without pulling out the pin 95 so that when the unit is descending through the water as shown in FIG. 1, it is suspended from the drogue 20 by the three lanyards 91, 93. However, when the legs are fully opened, the strap 97 pulls out the pin 95, thus releasing the ring 94 and the lanyard 93 so that the drogue 20 is pulled clear of the body as is indicated by FIG. 3.

In order to provide maximum strength with minimum weight and to provide a degree of cushioning, each of the legs is of double-skinned construction, as shown in FIG. 13, the two skins being separated by a high shear, low weight material such as honeycomb or expanded foam.

Various modifications may be made to the structure described. Therefore, the invention is intended to be limited not by the specific details of the preferred illustrative embodiment set forth above, but only by the scope of the appended claims and the reasonably equivalent structures thereto.

I claim:

1. A marine unit comprising: an elongate payload-containing body; and a plurality of legs adapted to rest on the sea bed and to maintain said body in an approximately vertical position, each of said legs being connected at one end to said body by a pivot adjacent the lower end of said body and each of said legs being pivotable from a closed position adjacent to said body to a deployed position extending away from said body;

an actuator in said body connected to said legs to pivot said legs simultaneously from said closed position to said deployed position, said actuator having a common axially-moving member; and means connecting each leg to said common member, said connecting means being so arranged that when said leg is in said deployed position forces on said leg tending to return said leg to said closed position do not act on said common member in a direction to tend to return said common member in a direction opposite to the deploying direction.

2. A unit according to claim 1, wherein said leg is connected to said common axially-moving member by a link which is pivoted to said leg at a point which is radially within the pivot axis of said leg.

3. A unit according to claim 1, wherein at the end of said unit remote from said pivotal axes of said legs there is a cover retained by the distal ends of said legs and released by the deployment of said legs.

4. A unit according to claim 3, which includes a ring which holds said legs against deployment and means for removing said ring on deployment.

5. A unit according to claim 4, which includes spring means tending to move said legs in the deployed direction when said ring is removed.

6. A unit according to claim 5, wherein said springs are arranged to provide cushioning to shield said body from impacts on said legs when said legs are in an initially deployed condition.

7. A unit according to claim 4, which includes dashpot means between said legs and said body for cushioning purposes.

8. A unit according to claim 7, which includes spring means tending to move said legs in the deployed direction when said ring is removed.

9. A unit according to claim 8, wherein said springs and said dashpot are combined in a single plunger and cylinder structure incorporating a coil spring.

10. A unit according to claim 1, which includes a drogue, means connecting said drogue to all said legs, and release means for releasing said connecting means from all but one of said legs on deployment of said legs.

11. A unit according to claim 1, wherein said actuator is a piston and cylinder.

12. A unit according to claim 11, wherein said actuator is an annular piston and cylinder coaxial with said body and of double-acting constant displacement construction.

* * * * *

UNITED STATES PATENT AND TRADEMARK OFFICE

CERTIFICATE OF CORRECTION

PATENT NO. : 4,967,683

DATED : Nov. 6, 1990

INVENTOR(S) : Arthur L. Brake, Andrew L. Pole and Charles D. Papworth

It is certified that error appears in the above-identified patent and that said Letters Patent is hereby corrected as shown below:

In Column 3, line 43, delete "421a, 43b" and insert therefor --42a, 42b--.

ON TITLE PAGE: item [75] Inventors: "Charles D. Papworth, Briston" should read --Charles D. Papworth, Bristol--.

Signed and Sealed this

Twenty-first Day of July, 1992

*Attest:*

DOUGLAS B. COMER

*Attesting Officer*

*Acting Commissioner of Patents and Trademarks*